United States Patent [19]

Carr

[11] Patent Number: 4,712,112

[45] Date of Patent: Dec. 8, 1987

[54] MINIATURE ANTENNA WITH SEPARATE SEQUENTIALLY WOUND WINDINGS

[75] Inventor: Francis Carr, Kanata, Canada

[73] Assignee: Siltronics Ltd., Ontario, Canada

[21] Appl. No.: 763,465

[22] Filed: Aug. 7, 1985

[30] Foreign Application Priority Data

Aug. 14, 1984 [CA] Canada ..... 461015

[51] Int. Cl.[4] ..... H01Q 7/08; H01Q 1/36

[52] U.S. Cl. ..... 343/788; 343/787; 343/895

[58] Field of Search ..... 343/702, 787, 788, 895

[56] References Cited

U.S. PATENT DOCUMENTS 2,932,027 3/1955 Crowley ..... 343/788

3,946,397 3/1976 Irwin ..... 343/788

4,101,899 7/1978 Jones, Jr. et al. ..... 343/788

*Primary Examiner*—William L. Sikes

*Assistant Examiner*—Doris J. Johnson

*Attorney, Agent, or Firm*—Laff, Whitesel, Conte & Saret

[57] ABSTRACT

The invention is a miniature antenna useful for portable radios, pocket pager receivers, etc. A plurality of sequentially wound windings is located on a ferrite core, each winding being connected in series with a capacitor. The resulting series circuits are connected in parallel with each other. Preferably the resonant frequency of each series circuit is approximately 80% to 90% of a receive frequency. An external tuning capacitance resonates with the net inductance of the antenna at the receive frequency. The antenna exhibits low hand effect while maintaining output EMF.

22 Claims, 5 Drawing Figures

MINIATURE ANTENNA WITH SEPARATE SEQUENTIALLY WOUND WINDINGS

This invention relates to an antenna which is particularly useful for portable radios, pocket pager receivers, etc.

As portable radios and pocket pagers shrink in size, the efficiency of the antenna becomes of great significance. Such antennas have been miniaturized by winding a wire helically around a ferrite core such as a ferrite rod of circular, rectangular or other cross-section, which forms an inductor coil. The antenna winding usually is connected in parallel with a trimmer capacitor, forming a parallel resonant circuit which has its highest impedance and maximum output voltage at the tuning frequency.

In order to maintain a high antenna output EMF at resonance as the frequency of operation is increased several important parameters have to be considered. The type of ferrite used and winding geometry have to be optimised. At VHF and UHF a practical limitation on coil size and hence inductance is the external tuning capacitor required in order to achieve resonance at the desired frequency. The number of turns and geometry of the coil(s) are somewhat limited due to the small antenna size.

In such antennae at VHF and UHF resonant frequencies, in the case in which a high impedance at the resonant frequency is achieved, a severe problem has been encountered, that is, the "hand effect". If the hand of a person or another grounded body approaches close to the antenna, stray capacitance is formed between the effectively grounded hand or other object and the antenna. This has been observed to significantly detune the antenna, severely reducing the sensitivity of the receiver-antenna combination.

Several techniques have been used to reduce the problem of hand effect detuning. In UK patent No. 2,117,182, dated Mar. 23, 1982, assigned to Multitone Electronics PLC, the antenna inductor is centrally split, the split being joined together by a capacitor. UK patent No. 1,063,784, dated Mar. 17, 1964, assigned to Matsushita Electric Industrial Company Inc., describes the use of a plurality of parallel connected inductors wound on a ferrite rod, the parallel connected windings being connected in parallel with the tuning capacitor.

In UK patent No. 1,507,864, dated Oct. 20, 1975, assigned to Motorola Inc., the antenna inductor is interrupted repeatedly by series connected capacitors, each inductor-capacitor pair forming a series resonant circuit. This arrangement hwever cannot be used when a parallel-resonant antenna is required. In the latter patent, series resonance, with minimum impedance at the resonance point is observed, rather than parallel resonance, with maximum impedance at the resonance point.

In U.S. Pat. No. 1,063,784, a larger inductance is observed, which requires the use of a very small resonating capacitance, and thus a larger hand effect is exhibited.

The ideal antenna would be small, have high efficiency, very low impedance to reduce the effect of stray capacitance, but provide a high output voltage. Thus it is desired that the antenna should have high Q with a maximum number antenna coil turns.

To make the antenna have high efficiency and gain, the ferrite core must be covered with a relatively large amount of conductor, the dimensions and positioning of which are optimised for maximum coil output EMF and hence unloaded Q-factor.

I have invented an antenna which provides the aforenoted desirable characteristics particularly well at VHF and UHF frequencies. My antenna is comprised of a plurality of conductive windings on a magnetic core, preferably formed of ferrite, each winding being connected in series with a corresponding capacitor to form a plurality of series circuits. The series circuits are each connected in parallel with each other.

Preferably the resonant frequency of each series circuit is from approximately 80% to 90% of the frequency at which the antenna is to be resonant. An external resonating capacitor which is preferably split into two capacitors connected in series in order to obtain an impedance transformation (one of which can be a trimmer capacitor), is connected in parallel with all of the parallel series circuits, and has a total capacitance selected to resonate with the series circuits at the optimum frequency to be received.

In order to maximize the voltage output from the antenna, the conductive windings on the core are formed of copper strips helically wound sequentially around the magnetic core, the spacing between each turn of the winding being a small fraction of the width of the strips of conductive material. A highly efficient antenna with minimum hand effect results.

A better understanding of the invention will be obtained by reference to the detailed description below, in conjunction with the following drawings in which.

Figure 1:
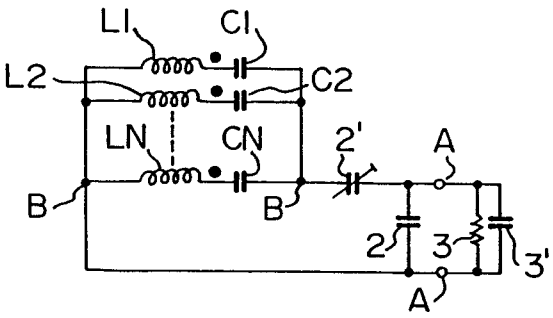
FIG. 1 is a schematic of the invention.

Turning to FIG. 1, a schematic diagram of the invention is shown. A plurality of coils L1, L2 . . . LN are wound helically and sequentially, in the same direction, on a ferrite rod (not shown). Capacitor C1, C2 . . . CN each is connected in series with a corresponding coil.

Figure 2:
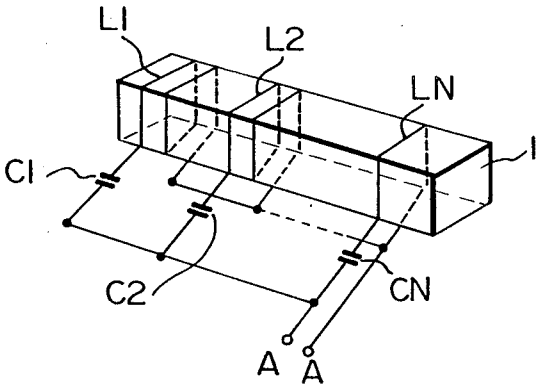
FIG. 2 is mechanical schematic illustrating the structure of the present antenna.

FIG. 2 illustrates the coils L1, L2 . . . LN wound on a core 1. The end of each winding closest to the same end of the core is connected in series with a corresponding capacitor C1, C2 . . . CN, and the series circuits thus resulting are connected in parallel to a pair of output terminals A, A, in their parallel aiding direction.

The parallel arrangement of series circuits thus provided is connected to external resonating capacitors 2 and 2' connected in series as shown in FIG. 1, the terminals A-A across capacitor 2 being connected to the input of a receiver circuit, represented schematically by the load resistor 3 in parallel with a capacitor 3'. Preferably capacitor 2' is a trimmer capacitor to facilitate tuning. Connection of the load across only capacitor 2 provides an impedance transformation for matching purposes.

It is preferred that the inductance of each of the coils L1-LN and the capacitance of each of the capacitors C1-CN should be chosen such that each series circuit formed by the inductor-capacitor pairs should be approximately 80% to 90% of the desired frequency to be received by the receiver. The total capacitance of capacitors 2 and 2' is chosen to resonate with the resultant inductance which could be measured at the points B-B to form a parallel resonant frequency at the frequency to be received.

As an example, for a receiver frequency of about 150 mHz, the inductance of each of the coils can be approximately 250 nH, and each of the series capacitors can be about 5.6 pF.

It has been found that the output impedance of the antenna measured at the terminals B-B is substantially less than that exhibited by a single series inductor and capacitor at the resonant frequency which produces the same output voltage at the resonant frequency. This makes the antenna significantly low in susceptibility to the effects of body capacitance, and to detuning due to the adjacency of the body or nearby ground. An antenna having low hand effect is thus achieved.

The result of the above structure is to maintain a certain output EMF while at the same time reducing the EMF source impedance. This allows a large number of turns, for the frequency used, to be wound on the ferrite core, and an optimum value of coupling established between induced coil EMF and the magnetic field present in the rod due to the signal to be received.

The external tuning capacitors 2' and fixed capacitor 2 tune the circuit to resonance, and also performs an impedance transformation which transforms the antenna impedance at B-B to a lower one. The values of the inductances should be chosen so that the net effective inductance combined with the series circuit capacitors and the external tuning and fixed capacitors resonate at the required frequency and has sufficient unloaded Q to produce a desired output EMF to the receiver load 3.

Figure 3:
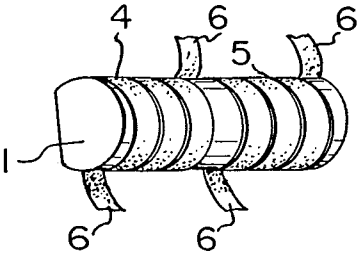
FIG. 3 is a mechanical drawing of the inductor portion of the present invention.

It has been found that at VHF frequencies the Q is increased by forming the coils out of wide conductive strips. Since high conductivity is desired, preferably the strips are formed of copper. In order to maximize the efficiency, as much conductor as possible should be wound on the core. FIG. 3 illustrates a practical antenna structure, without the capacitors.

A ferrite core 1 of uniform cross-sectional area is shown wound with two windings 4 and 5 made of copper strip. For circular cross-section shown in FIG. 3 modified to a D-shape the rod diameter is about 10 mm in width and 30 mm in length. The copper strip, according to one successful model was 3 mm in width and 0.13 mm in thickness. As may be seen, virtually the entire surface area of the core 1 is covered by the two coils, the windings of the coils being spaced a very small fraction of the width of the copper strip. One of the ends of all the coils 6 should be connected together and the other end of each to capacitors as shown in FIGS. 1 and 2.

In a two winding antenna of the kind shown in FIG. 3, each of the series circuit capacitors should be equal in value. It is preferable that the capacitance of each of the series circuit capacitors should be about the same value as the series combination of capacitors 2', and 2' and 3' in parallel.

In the multi-winding antenna, each of the series circuit capacitors should typically be of the same capacitance value. However end effects can affect the resonance point of the windings adjacent to the opposite ends of the core, and for antennae with a large number of windings in which the absolute maximum output EMF is desired, the capacitance values of the capacitors in series with those end windings may have to be different in values from the other series circuit capacitors.

Figure 4:
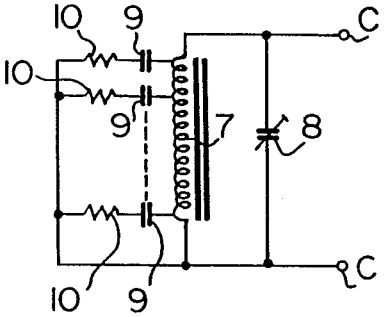
FIG. 4 is a schematic used to illustrate the hand effect problem encountered by the prior art.

FIG. 4 is a schematic diagram of a prior art antenna illustrating the hand effect problem. An antenna winding 7 has a capacitor 8 connected in parallel with it to provide a high impedance and maximum output voltage at terminals C-C at the resonant frequency. Due to the high impedance, stray lossy capacitance 9 (the amount of loss being modeled with series resistance 10) is distributed along the coil when it is in close proximity to the human body or an adjacent ground. The stray capacitance is of course distributed, but is shown as lumped in FIG. 4. Clearly, the presence of the stray capacitance, which of course varies in value as the body is brought closer or farther from the antenna, constitutes a capacitance parallel to the tuning capacitor 8, thus varying the resonance point of the antenna, thus reducing the output EMF at the terminals A-A at the receive frequency.

Figure 5:
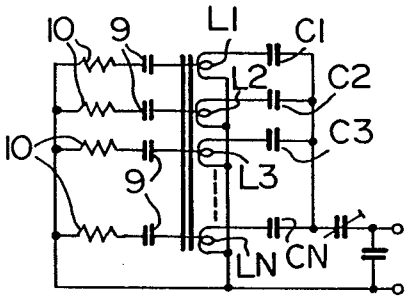
FIG. 5 is a schematic used to illustrate how the prior art problem is substantially reduced according to the present invention.

Consider now the schematic shown in FIG. 5, which illustrates the present invention. A plurality of coils each is in series with a capacitor C1-CN. The stray lossy capacitance is shown in FIG. 4. Each series resonant circuit exhibits low impedance at resonance. If the inductance and unloaded Q-factor of each of the N coils is maintained at a value not significantly less than that of a single large coil wound on the same type of ferrite rod the distributed stray lossy capacitance due to hand effect is significantly reduced over that of a single tuned circuit producing approximately the same output EMF at resonance. The effect of joining N series resonant circuits, all part of the same antenna structure, in parallel, is to decrease the source impedance of the antenna while at the same time maintaining the output EMF.

The present invention thus provides a significantly improved miniature antenna for parallel tuned receivers at VHF and UHF frequencies, exhibiting low "hand effect" detuning of the antenna.

A person understanding this invention may now conceive of variations or other embodiments which use the principles described herein. All such embodiments are considered to be within the scope of the invention as defined in the claims appended hereto.

I claim:

1. An antenna comprising a plurality of sequentially wound separate conductive windings on a magnetic core, each winding being connected in series with a corresponding capacitor to form a plurality of series circuits, the series circuits being connected in parallel with each other in parallel aiding direction.

2. An antenna as defined in claim 1 including means for connecting the antenna to a receiver for receiving a radio frequency signal at a predetermined frequency, the resonant frequency of each series circuit being below said predetermined frequency.

3. An antenna as defined in claim 2 in which the resonant frequency of each series circuit is approximately 80% to 90% of said predetermined frequency.

4. An antenna as defined in claim 3, in which the core is formed of ferrite.

5. An antenna as defined in claim 3, in which the conductive windings are formed of strips of conductive material helically wound sequentially around the magnetic core, the spacing between each turn of each winding being a small fraction of the width of a strip of conductive material.

6. An antenna as defined in claim 3, in which the magnetic core is formed of ferrite, and in which the conductive windings are formed of thin strips of coper helically wound sequentially around the magnetic core, the spacing between each turn of each winding being a small fraction of the width of the strips of copper.

7. An antenna as defined in claim 3 in which the core is formed of ferrite, and further including tuning capacitor means connected in parallel with the plurality of series circuits, the capacitance of the tuning capacitor means being selected to resonate with the plurality of series circuits at said predetermined frequency.

8. An antenna as defined in claim 3 in which the conductive windings are formed of strips of conductive material helically wound sequentially around the magnetic core, the spacing between each turn of each winding being a small fraction of the width of the strips of conductive material, and further including a tuning capacitor connected in parallel with the plurality of series circuits, the capacitance of the tuning capacitor being selected to resonate with the plurality of series circuits at said predetermined frequency.

9. An antenna as defined in claim 3 in which the magnetic core is formed of ferrite, and in which the conductive windings are formed of thin strips of copper helically wound sequentially around the magnetic core, the spacing between each turn of each winding being a small fraction of the width of the strips of copper, and further including a tuning capacitor means connected in parallel with the plurality of series circuits, the capacitance of the tuning capacitor means being selected to resonate with the plurality of series circuits at said predetermined frequency.

10. An antenna as defined in claim 3 in which the core is formed of ferrite, and further including a series pair of capacitors connected in parallel with the plurality of series circuits, the total capacitance of the series pair of capacitors being selected to resonate with the plurality of series circuits at said predetermined frequency.

11. An antenna as defined in claim 3 in which the core is formed of ferrite, and further including a series pair of capacitors, one being variable in capacitance, the pair being connected in parallel with the plurality of series circuits, the total capacitance of the series pair of capacitors being selected to resonate with the plurality of series circuits at said predetermined frequency, the output signal of the antenna being obtained across the other of the series pair of capacitors.

12. An antenna as defined in claim 2 in which the core is formed of ferrite, and further including tuning capacitor means connected in parallel with the plurality of series circuits, the capacitance of the tuning capacitor means being selected to resonate with the plurality of series circuits at said predetermined frequency.

13. An antenna as defined in claim 2 in which the conductive windings are formed of strips of conductive material helically wound sequentially around the magnetic core, the spacing between each turn of each winding being a small fraction of the width of the strips of conductive material, and further including a tuning capacitor connected in parallel with the plurality of series circuits, the capacitance of the tuning capacitor being selected to resonate with the plurality of series circuits at said predetermined frequency.

14. An antenna as defined in claim 2 in which the magnetic core is formed of ferrite, and in which the conductive windings are formed of thin strips of copper helically wound sequentially around the magnetic core, the spacing between each turn of each winding being a small fraction of the width of the strips of copper, and further including a tuning capacitor means connected in parallel with the plurality of series circuits, the capacitance of the tuning capacitor means being selected to resonate with the plurality of series circuits at said predetermined frequency.

15. An antenna as defined in claim 2 in which the core is formed of ferrite, and further including a series pair of capacitors connected in parallel with the plurality of series circuits, the total capacitance of the series pair of capacitors being selected to resonate with the plurality of series circuits at said predetermined frequency.

16. An antenna as defined in claim 2 in which the core is formed of ferrite, and further including a series pair of capacitors, one being variable in capacitance, the pair being connected in parallel with the plurality of series circuits, the total capacitance of the series pair of capacitors being selected to resonate with the plurality of series circuits at said predetermined frequency, the output signal of the antenna being obtained across the other of the series pair of capacitors.

17. An antenna as defined in claim 2, in which the core is formed of ferrite.

18. An antenna as defined in claim 2, in which the conductive windings are formed of strips of conductive material helically wound sequentially around the magnetic core, the spacing between each turn of each winding being a small fraction of the width of a strip of conductive material.

19. An antenna as defined in claim 2, in which the magnetic core is formed of ferrite, and in which the conductive windings are formed of thin strips of coper helically wound sequentially around the magnetic core, the spacing between each turn of each winding being a small fraction of the width of the strips of copper.

20. An antenna as defined in claim 1, in which the core is formed of ferrite.

21. An antenna as defined in claim 1, in which the conductive windings are formed of strips of conductive material helically wound sequentially around the magnetic core, the spacing between each turn of each winding being a small fraction of the width of a strip of conductive material.

22. An antenna as defined in claim 1, in which the magnetic core is formed of ferrite, and in which the conductive windings are formed of thin strips of copper helically wound sequentially around the magnetic core, the spacing between each turn of each winding being a small fraction of the width of the strips of copper.

* * * * *